US007257981B2

(12) United States Patent
Natsui et al.

(10) Patent No.: US 7,257,981 B2
(45) Date of Patent: Aug. 21, 2007

(54) CLOSED FORGING METHOD, FORGING PRODUCTION SYSTEM USING THE METHOD, FORGING DIE USED IN THE METHOD AND SYSTEM, AND PREFORM OR YOKE PRODUCED BY THE METHOD AND SYSTEM

(75) Inventors: Masayuki Natsui, Kitakata (JP); Takafumi Nakahara, Kitakata (JP)

(73) Assignee: Showa Denko K.K., Tokyo (JP)

( * ) Notice: Subject to any disclaimer, the term of this patent is extended or adjusted under 35 U.S.C. 154(b) by 534 days.

(21) Appl. No.: 10/473,299

(22) PCT Filed: Mar. 29, 2002

(86) PCT No.: PCT/JP02/03165

§ 371 (c)(1),
(2), (4) Date: Sep. 29, 2003

(87) PCT Pub. No.: WO02/078875

PCT Pub. Date: Oct. 10, 2002

(65) Prior Publication Data

US 2004/0093926 A1 May 20, 2004

Related U.S. Application Data

(60) Provisional application No. 60/281,810, filed on Apr. 6, 2001.

(30) Foreign Application Priority Data

Mar. 29, 2001 (JP) ..... 2001-096193

(51) Int. Cl.
*B21D 31/00* (2006.01)

(52) U.S. Cl. ..... 72/377; 72/358; 72/352; 72/356; 72/359

(58) Field of Classification Search ..... 72/355.6, 72/358, 359, 354.6, 352, 377, 254, 275, 356
See application file for complete search history.

(56) References Cited

U.S. PATENT DOCUMENTS 2,814,101 A * 11/1957 Prough et al. ..... 72/342.8

(Continued)

FOREIGN PATENT DOCUMENTS

| | | | |
|---|---|---|---|
| JP | 51093764 A | * | 8/1976 |
| JP | 62-173046 A | | 7/1987 |
| JP | 64018534 | * | 1/1989 |
| JP | 64018543 | * | 1/1989 |

(Continued)

OTHER PUBLICATIONS

English-language Patent Abstracts of Japan, abstracting JP 06-071373, published Mar. 15, 1994.
Machine translation of JP 06-071373, published Mar. 15, 1994.

*Primary Examiner*—Dmitry Suhol
(74) *Attorney, Agent, or Firm*—Sughrue Mion, PLLC

(57) ABSTRACT

A closed forging method for producing a forged product includes preparing as a forging material a cylindrical cast ingot that has a volume the same as the volume of a forged product and assumes a shape having an upper surface, a lower surface and a side surface and containing no angular portion; and applying pressure to the side surface of the forging material. The shape has a ratio of the lateral length of a projection profile of the forging material as viewed in the direction perpendicular to the direction of pressure application to a length of the forging material as measured in the direction of pressure application is 1 or less. The forged product obtained is a preform of an upper arm or a lower arm with a plurality of branches that is a suspension part for a vehicle or a yoke with a plurality of branches that is a joint part employed in a vehicle suspension. The preform or yoke has metal flow lines along each branch and exhibits enhanced mechanical strength.

7 Claims, 12 Drawing Sheets

U.S. PATENT DOCUMENTS

| | | | | | |
|---|---|---|---|---|---|
| 3,691,804 | A | * | 9/1972 | Clendenin et al. | 72/42 |
| 4,147,074 | A | * | 4/1979 | Noguchi et al. | 74/559 |
| 4,222,260 | A | * | 9/1980 | McDermott | 72/345 |
| 4,377,085 | A | * | 3/1983 | McDermott et al. | 72/359 |
| 4,426,872 | A | * | 1/1984 | Gatny | 72/359 |
| 6,151,948 | A | | 11/2000 | Ashworth et al. | |

FOREIGN PATENT DOCUMENTS

| | | | | |
|---|---|---|---|---|
| JP | 1-166842 | A | | 6/1989 |
| JP | 02-030351 | A | | 1/1990 |
| JP | 06071373 | A | * | 3/1994 |
| JP | 11179479 | A | * | 7/1999 |

* cited by examiner

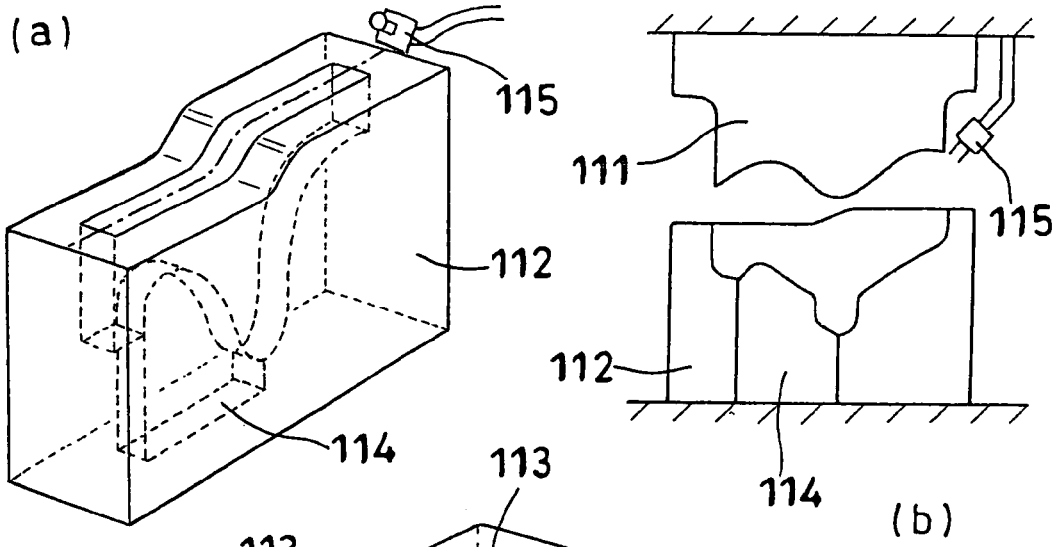
Fig.11
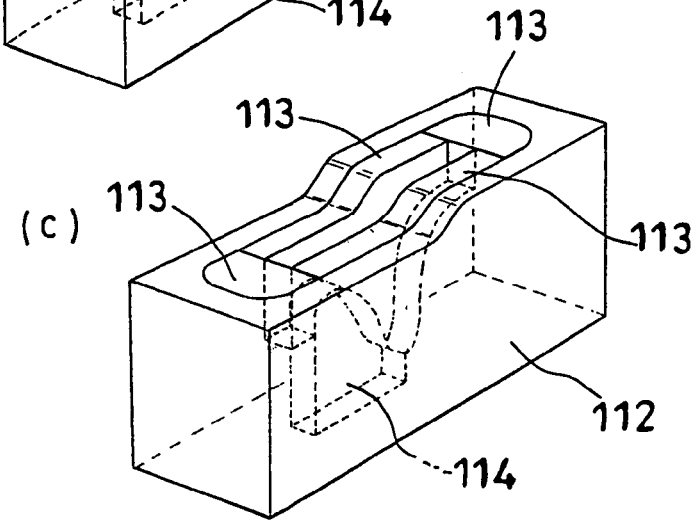
Fig. 12
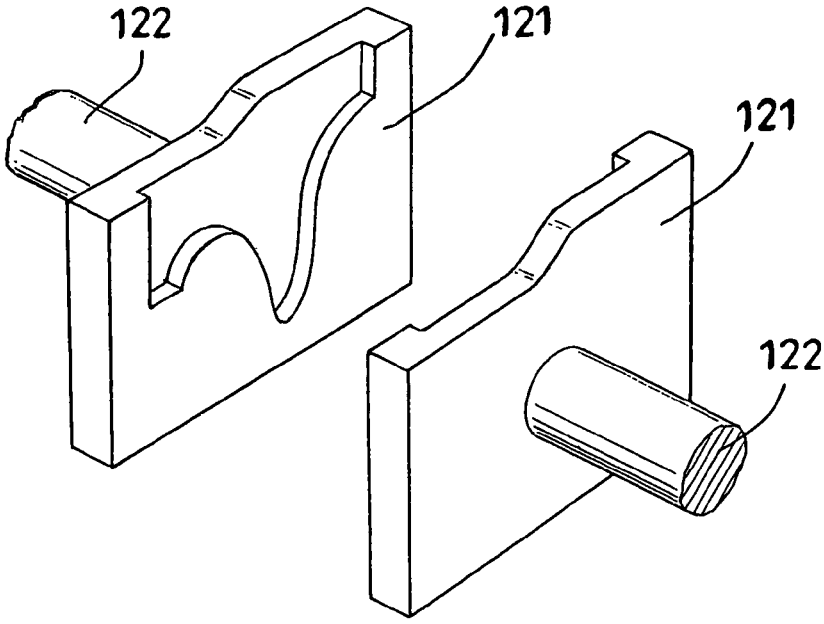

CLOSED FORGING METHOD, FORGING PRODUCTION SYSTEM USING THE METHOD, FORGING DIE USED IN THE METHOD AND SYSTEM, AND PREFORM OR YOKE PRODUCED BY THE METHOD AND SYSTEM

CROSS REFERENCE TO RELATED APPLICATIONS

This application is an application filed under 35 U.S.C. § 111(a) claiming the benefit pursuant to 35 U.S.C. § 119(e)(1) of the filing date of U.S. Provisional Application Ser. No. 60/281,810 filed. Apr. 6, 2001 pursuant to 35 U.S.C. § 111(b).

TECHNICAL FIELD

The present invention relates to a closed forging method, a forging production system using the method, a forging die used in the method and system, and a suspension part for a vehicle and a preform or yoke of the part produced by the method and system.

BACKGROUND ART

Joint parts employed in a vehicle suspension include a yoke 43 shown in FIG. 2, which has a plurality of branches 21, 22 and 23.

Conventionally, the yoke has been formed, as shown in FIG. 3, by forging a solid round bar 31 that is a material to be subjected to forging into a forged product having a flash 32 formed at its periphery.

Alternatively, as shown in FIG. 4, a product 43 (i.e., a yoke) has been formed by subjecting to mechanical machining a portion 42 of a yoke preform 41 that has been extruded and cut so as to assume a shape substantially similar to that of the product.

Recently, instead of iron, aluminum alloy has been increasingly used for producing suspension parts for vehicles in order to reduce the weight of the parts. The suspension parts for vehicles have been produced through forging in order to enhance their mechanical strength and to reduce the amount of raw material used for producing a product. Examples of the suspension parts for vehicles include an upper arm and a lower arm.

Since an upper arm 54 shown in FIG. 5, which is a suspension part for a vehicle, has branches 51, 52 and 53 extending in three directions, production of the upper arm in a single forging step is difficult. Therefore, conventionally, the upper arm has been produced by producing an upper arm preform 61 as shown in FIG. 6 having a shape similar to that of a final product through forging and subjecting the preform to a plurality of forging steps to thereby cause the preform to assume the shape of the upper arm 54 shown in FIG. 5.

Specifically, a solid round bar 71 as shown in FIG. 7 is subjected to forging by use of a forging die, and then a flash 72 is removed from the forged body by use of a trimming die to thereby produce an upper arm forging preform 73. Subsequently, the preform 73 is subjected to a plurality of forging steps to thereby obtain a vehicle upper arm 74. In this case, in order to reduce loss of the material incurred by the formation of the flash, there is employed a forging die having a configuration allowing a plurality of upper arm preforms 73*a* to be produced from one solid round bar material in a single step.

Meanwhile, a closed forging method in which-no flash is formed is known as a method for forging a disk-shaped material 82 into a product of simple form, which is, for example, a simple circular or cylindrical product such as a VTR cylinder 81 shown in FIG. 8.

JP-A HEI 1-166842 discloses a method for producing through closed forging a product having a plurality of branches. In the method disclosed in this publication for producing a product having a plurality of radially extending branches, as shown in FIG. 9, a punch 91 is used to apply pressure to a solid round bar material so as to fill impressions provided in upper and lower dies 93 and 94 to thereby form radially extending branches 92 through closed forging.

The conventional method shown in FIG. 3, in which flashes are formed, requires a trimming step for removing the flashes subsequent to a forging step. In such a method, since unwanted flashes are formed around a forged body, the yield of the product on the basis of a forging material is low. In addition, since the projection area of the forged body as viewed in the direction perpendicular to the direction of pressure application is large, a large, expensive forging machine capable of applying high load is required, resulting in high production cost.

Also, in the conventional method shown in FIG. 4 in which the preform 41 which has been obtained through cutting of an extruded material is subjected to machining to thereby produce a yoke 43, since the portion 42 is subjected to machining, a large allowance must be provided for machining, and as a result, the yield of a final product on the basis of the preform is low. In addition, the method requires steps for machining, resulting in high production cost.

The aforementioned conventional method for producing a preform of an upper arm or lower arm, which is a suspension part for a vehicle, requires a trimming step for removing flashes subsequent to a forging step. In this method, since unwanted flashes are formed around the preform, the yield of the preform on the basis of the material is low. In addition, since the projection area of the forged body as viewed in the direction perpendicular to the direction of pressure application is large, a large, expensive forging machine capable of applying high load is required, resulting in high production cost.

In the closed forging method disclosed in JP-A HEI 1-166842, pressure is applied in a direction perpendicular to the cut surface of a cylindrical material so as to cause plastic flow of the material, thereby forming radially extending branches 92. Therefore, when the branches 92 are long or fail to attain uniform length (i.e., the branches have different shapes), forging defects such as underfill and overlap on the surface of a forged product may be generated, because of the difference in the rate or direction of plastic flow of the material between portions of the forged product.

In view of the foregoing, one object of the present invention is to provide a closed forging method for producing a member having a plurality of branches, in which load applied to a raw material is reduced during forging and the yield of a final product on the basis of the raw material is improved; a forging production system employing the method; and a forging die employed in the method and system.

Another object of the present invention is to provide a method for efficiently producing a suspension part for vehicles and a preform or yoke thereof at low cost.

Still another object of the present invention is to provide a forged product of high mechanical strength, which is produced by causing plastic flow of a forging material to occur along a plurality of branches to thereby form layers of metal flow in the branches.

The term "materials" used throughout the description refers to articles not forged, which include ingots, forging materials, cut pieces, solid round bars, raw materials, cylindrical materials, continuous forging round bars, disks and billets.

The term "preforms" used throughout the description refer to products obtained by forging but required to undergo at least one further forging step into a final product, which include yoke performs, upper arm performs and upper arm forging performs.

The term "forged products" used throughout the description refers to products having been forged, which include members, products, final products, forged bodies and forged articles.

DISCLOSURE OF THE INVENTION

The present invention provides a closed forging method for producing a forged product, which comprises preparing as a forging material a cylindrical cast ingot that has a volume the same as a volume (V) of a forged product and assumes a shape having an upper surface, a lower surface and a side surface and containing no angular portion; and applying pressure to the side surface of the forging material, wherein the shape has a ratio of a lateral length of a projection profile of the forging material as viewed in a direction perpendicular to a direction of pressure application to a length of the forging material as measured in the direction of pressure application is 1 or less.

The forging material is a cut piece obtained from a round bar and has a ratio (T/R) of a cut piece thickness (T) to a cut piece diameter (R) that is 1 or less.

The volume (V) of the forged product, the cut piece thickness (T), a longitudinal length (L) of the projection profile of the forged product as viewed in the direction of pressure application, and the cut piece diameter (R) satisfy $(1/3)\times L \leqq R = 2\times\sqrt{(V/T\pi)} \leqq L$.

The cut piece thickness (T) is 0.8 to 1.0×(a lateral length (t) of the projection profile of the forged product as viewed in the direction perpendicular to the direction of pressure application).

The forging material is formed of aluminum or aluminum alloy.

The forged product is a member having a plurality of branches which have no flash removal mark and along each of which metal flow lines are formed, and the member is a preform of an upper arm or a lower arm that is a suspension part for a vehicle, or a yoke that is a joint part-employed in a vehicle suspension.

The present invention also provides a forging die used in the closed forging method, comprising a punch, a die and a knock-out, or comprising a punch and separate-type dice having a drive mechanism.

The present invention also provides a forging production system comprising an apparatus for cutting a forging material and a forging machine, wherein the forging machine is a forging die comprising a punch, a die and a knock-out or comprising a punch and separate-type dice having a drive mechanism.

In the closed forging method according to the present invention, as described above, there is used a cylindrical forging material that has a volume the same as the volume of a forged product and assumes a shape containing no angular portion and having a ratio of a lateral length of a projection profile of the forging material as viewed in the direction perpendicular to the direction of pressure application to the length of the forging material as measured in the direction of pressure application, which ratio is 1 or less. Since pressure is applied to the side surface of the forging material to cause plastic flow of the forging material to occur along a plurality of branches of a forged product to thereby form layers of metal flow in the branches, the forged product exhibits improved mechanical features and has no flash removal mark. This enhances the yield of products on the basis of the forging material.

Since plastic flow of the forging material is caused to occur along a plurality of branches of a forged product to thereby form layers of metal flow in the branches, the perform of the upper arm or lower arm that is a suspension part for a vehicle, or the yoke that is a joint part employed in a vehicle suspension, produced through the closed forging method of the present invention exhibits improved mechanical features.

In the die employed in the closed forging method of the present invention, the shape of a space defined by a combination of a punch, a die and a knock-our or bush, or by a combination of a punch and a die having a drive mechanism has a volume the same as the volume of a forged product and a ratio of a lateral length of a projection profile of the forging material as viewed in the direction perpendicular to the direction of pressure application to the length of the forging material as measured in the direction of pressure application, which ratio is 1 or less. In addition, the die has a configuration that enables pressure to be applied to the side surface of a cylindrical forging material. Therefore, the pressure applied during the forging can be reduced, and the yield of the products on the basis of the forging material can be enhanced.

BRIEF DESCRIPTION OF THE DRAWINGS

FIG. 11 is a schematic representation showing the structure of a closed forging die of yet another embodiment of the present invention, FIG. 11(*a*) being a perspective view showing an example of a unit-type die, FIG. 11(*b*) being a cross-sectional view of the die shown in FIG. 11(*a*) and FIG. 11(*c*) being a perspective view showing one example of separate-type dice.

FIG. 12 a schematic perspective view showing another example of the separate-type dice used in the closed forging of the present invention.

BEST MODE FOR CARRYING OUT THE INVENTION

Figure 1:
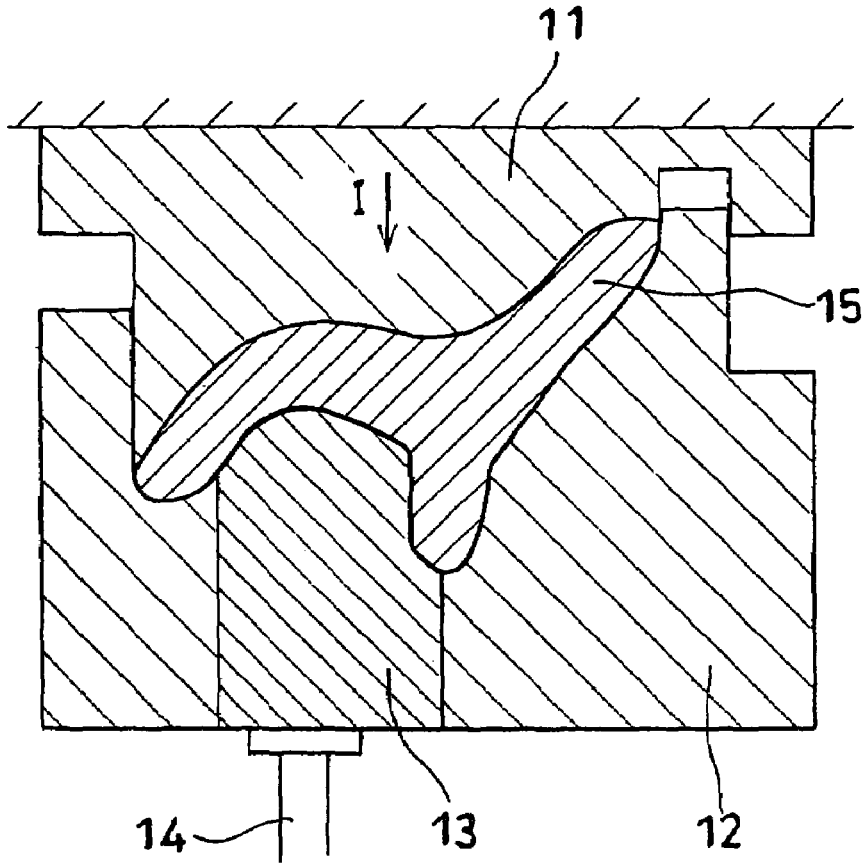
FIG. 1 a cross-sectional view showing one embodiment of the present invention in a state in which a punch reaches a drop end when a forging preform of an upper arm, which is a suspension part for a vehicle, has been forged.

The present inventors have performed extensive studies on a closed forging method and a closed forging production system for producing a forged product, on enhancement of the yield of a final product on the basis of a raw material and on the relation between metal flow in a forged product and the mechanical strength of the product. The present invention has been accomplished on the basis of the knowledge.

The forging-material employed in the present invention is a cylindrical cast ingot that has the same volume as a forged product and assumes a shape having an upper surface, a lower surface and a side surface, containing no angular portion and having a ratio of the lateral length of a projection profile of the ingot as viewed in the direction perpendicular to the direction of pressure application to the length of the ingot as measured in the direction of pressure application, which ratio is 1 or less.

The expression that "a forging material has the same volume as a forged product" as used herein refers to the case where the volume of the forging material falls within the range of an acceptable volume tolerance of the forged product. The difference in volume between the forging material and the forged product is preferably 2% or less, more preferably 1% or less, on the basis of the volume of the forged product.

When the volume of a forging material is not the same as that of a forged product, there arise problems including the problem that when the volume of a forged product is greater than that of a forging material, underfill occurs in the forged product and the problem that when the volume of a forged product is smaller than that of a forging material, since flashes are formed on the forged product, the forged product cannot be used as a final product, or a forging die is broken, resulting in failure of production of a forged product. In addition, a step for removing flashes is required. This increases the number of operation steps. Furthermore, in conjunction with removal of flashes, the yield of a forged product on the basis of a forging material becomes low.

The forged product produced through the method of the present invention is preferably a member having a plurality of branches. The expression "a member having a plurality of branches" as used herein refers to a member having a plurality of branches (each branch serving as a portion to be joined with or supported by another member when the member is used in combination with the another member, for example) in which each branch extends from its end through an arbitrary path toward the confluence (e.g., the center of gravity) which falls within a polygon formed by connecting the ends of the branches. This definition encompasses the case where the branches have no side branch and the case where the confluence of the branches is the end of a certain branch.

In order to reduce the weight of the member, the branches may be punched to form holes therein. The member may also be seen as a member having a plurality of branches extending from the confluence of the branches. The present invention may be applied to a member having extending branches that are symmetrical or asymmetrical with respect to the confluence of the branches. Examples of the member include a yoke, which is a joint part employed in a suspension part for vehicles, and an upper arm and a lower arm, which are suspension parts for vehicles. For such parts, further improvement in the mechanical strength of branches thereof is desired.

The present invention provides a closed forging method comprising preparing as a forging material a cylindrical cast ingot which assumes a shape having an upper surface, a lower surface and a side surface and containing no angular portion; and applying pressure onto the side surface of the forging material, wherein the shape has a ratio of the lateral length of a projection profile of the ingot in a direction perpendicular to the direction of pressure application to the length of the forging material as measured in the direction of pressure application, which ratio is 1 or less.

The expression "a cylinder having an upper surface, a lower surface and a side surface and containing no angular portion" refers to, for example, a cylindrical object having a lower surface defined by a curve containing no angular portion and a truncated cone, cylindroid and truncated elliptical cone each having a lower surface defined by a curve containing no angular portion.

When the ratio of the lateral length of a projection profile of a forging material as viewed in the direction perpendicular to the direction of pressure application to the length of the forging material as measured in the direction of pressure application exceeds 1, the projection area of the forging material as viewed in the direction perpendicular to the direction of pressure application becomes large, requiring a high forging load, which may tend to be excessively great to thereby prevent reliable forging. Such an increase in forging load adversely affects forging of both a preform of an upper arm or a lower arm, which is a suspension part for a vehicle, and a yoke that is a joint part employed in a vehicle suspension. Furthermore, a forging machine capable of applying high load is expensive, resulting in high production cost.

In the present invention, since pressure is applied onto the side surface of a forging material; plastic flow of the material starts at a portion of small projection area to proceed in the longitudinal direction, resulting in enhancement of the strength of that portion. When a forged product is a member having a plurality of branches, stratiform metal flow occurs along the contour of the branches, resulting in enhancement of the strength of the branches.

The present invention provides a closed forging method in which pressure is applied onto the side surface of a forging material. When the forging material is a cut piece obtained from a round bar material, pressure is applied during forging, not onto a cut surface of the piece, but onto the surface perpendicular to the cut surface of the piece. Specifically, pressure is applied onto the side surface of the cut piece.

In a forging method in which pressure is applied onto the cut surface of a cut piece obtained from a round bar material, during production, through plastic flow of the piece (the forging material), of a preform with branches of an upper arm or a lower arm which is a suspension part for a vehicle, or a yoke with branches which is a joint part employed in a vehicle suspension, an edge at which the cut surface meets the outer peripheral surface (side surface) of the piece becomes a branch of a forged product. In this case, since the rate and the direction of plastic flow of the forging material differ from portion to portion in the cut surface and the outer peripheral surface of the material, forging defects attributed to the aforementioned edge, such as overlap, are generated on the surface of the branch of the forged product. As a result, the forged product may be broken at a portion at which the forging defects are generated, making the product unusable as a high-quality product.

The present invention employs, as a forging material, a cylindrical cast ingot having an upper surface, a lower surface and a side surface and containing no angular portion, and pressure is applied onto the side surface of the cylindrical forging material. Therefore, since plastic flow of the material occurs such that the aforementioned edge falls on the peripheral outline of a forged product, generation of forging defects, such as overlap, in the branches of the forged product can be prevented. Furthermore, since the ratio of the lateral length of a projection profile of the forging material in a direction perpendicular to the direction of pressure application to the length of the material as measured in the direction of pressure application is 1 or less, the projection area of the forging material as viewed in the direction perpendicular to the direction of pressure application becomes small, and forging load to be applied can be reduced.

When pressure is applied onto the outer peripheral surface (i.e., the surface perpendicular to the cut surface) of a cut piece obtained from a round bar material and serving as a cylindrical forging material, since plastic flow of the material occurs such that the aforementioned edge falls on the peripheral outline of a forged product, generation of forging defects, such as overlap, in the branches of the forged product can be prevented, which is preferable. Furthermore, since the ratio of thickness of the cut piece to the diameter of the cut piece is 1 or less, the projection area of the cut piece (the forging material) as viewed in the direction perpendicular to the direction of pressure application becomes small, and forging load to be applied can be reduced, which is preferable.

In the method of the present invention, the outline of the upper surface and/or the lower surface of a forging material preferably contains no angular portion and assumes a smooth shape. More preferably, the outline assumes a circular shape, an elliptical shape or a smoothly extending polygonal shape, since such shapes can prevent generation of forging defects such as overlap.

From the viewpoints of cost and workability, the forging material employed in the present invention is preferably a cylindrical cut piece obtained from a round bar material so that the ratio (t/R) of the thickness (T mm) of the piece to the diameter (R mm) of the piece is 1 or less (preferably ($\pi/4$) or less, more preferably 0.5 or less).

In the method of the present invention, the forging material may be a metallic material. Examples of the metallic material include aluminum, iron, magnesium and an alloy predominantly containing such a metal. Examples of the aluminum alloy include Al—Mg—Si alloy, Al—Cu alloy and Al—Si alloy. Examples of Al—Mg—Si alloy include JIS 6061 alloy and SU 610 alloy. Examples of Al—Cu alloy include JIS 2024 alloy and JIS 2014 alloy. An example of Al—Si alloy is JIS 4032 alloy.

The forging material employed in the present invention may be produced by means of any customary method, such as continuous casting, extrusion or rolling. A continuously cast round bar material of aluminum or aluminum alloy is preferable in view of low cost. A round bar material of aluminum alloy (e.g., SHOTIC material) which is continuously cast by means of an air-pressurized hot top casting process is more preferable, since the material exhibits excellent internal soundness and has fine crystal grains that exhibit no anisotropy attributed to plastic working. This is why when the round bar material of aluminum alloy (a forging material) is employed in the forging method of the present invention, stratiform plastic flow of the material occurs uniformly in branches of a forged product, resulting in generation of no forging defect such as underfill and in enhancement of the mechanical strength of the product.

In the forging method of the present invention, preferably, the volume (V $mm^3$) of a forged product, the thickness (T mm) of the round bar material, the longitudinal length (L mm) of a projection profile of the forged product as viewed in the direction perpendicular to the direction of pressure application, and the diameter (R mm) of the round bar material satisfy the relation:

$$(1/3)\times L \leqq R = 2\times\sqrt{(V/T\pi)} \leqq L.$$

In the case where $R=2\times\sqrt{(V/T\pi)}<(1/3)L$ (R: diameter of a cut piece obtained from the round bar material), since a forging load higher than the maximum load obtained from a press must be applied to the cut piece (the forging material) so as to cause plastic flow of the material in branches of a forged product through a single forging step, a plurality of forging steps are required. In addition, as a result of insufficient application of load, underfill may arise in a forged product, resulting in failure to produce an intended forged product. In this case, the distance of plastic flow of the forging material becomes long, and a lubrication film provided between the forging material and a die is broken, resulting in generation of forging defects, such as sticking and galling, on the forged product. Therefore, mechanical processing may be required for removing the forging defects. Meanwhile, in the case where $L<R=2\times\sqrt{(V/T\pi)}$, since the cut piece cannot be placed in a forging die, closed forging cannot be performed.

Regarding the round bar material (the forging material) employed in the present invention, preferably, the thickness (T mm) of the round bar material is 0.8 to 1.0×(the lateral length (t mm) of a projection profile of a forged product as viewed in the direction perpendicular to the direction of pressure application). When the thickness of a cut piece obtained from the round bar material is at least 0.8×t and up to 1.0×t, the forging material is not inclined in a forging die, and the material placed in the die is stabilized in the die. Therefore, forging defects, such as underfill, thickness deviation and overlap, do not arise during forging, resulting in production of a forged product of high quality. However, when the thickness of the cut piece exceeds 1.0×t, since the forging material cannot be placed in the forging die, closed forging without formation of flashes cannot be performed.

According to the closed forging method of the present invention, pressure is applied to the side surface of cylindrical cast ingot employed as a forging material. In addition, the cast ingot has the same volume as a forged product and assumes a shape containing no angular portion in its upper, lower and side surfaces and having the ratio of the lateral length of a projection profile of the ingot as viewed in a direction perpendicular to the direction of pressure application to the length of the ingot as measured in the direction of pressure application, which ratio is 1 or less. Therefore, load to be applied during forging can be reduced, the yield of a forged product on the basis of the forging material is high, and the mechanical strength of the forged product can be enhanced.

According to the method of the present invention, a forging preform of an upper arm or a lower arm, which is a suspension part for a vehicle, can be produced by applying load onto the side surface of a cylindrical forging material. In addition, load to be applied during forging can be reduced, and the yield of a final product on the basis of the forging material is high. The forging preform of an upper arm or a lower arm, which is a suspension part for a vehicle, is produced by means of the forging method such that plastic flow of the forging material occurs along a plurality of branches. That is, stratiform metal flow occurs along the contours of the branches. As a result, the mechanical strength of the branches is enhanced.

The term "metal flow" as used herein refers to flow of crystal grains of a forged product produced through forging, which is a form of plastic working. The expression that "stratiform metal flow occurs" refers to the state where crystal grains flow uniformly along the contour of a forged product. That is, metal flows in layers along the contour of a forged product, and the layers do not end at the surface of the product, or disturbance of the layers is not observed in the product. In other words, the forged product has metal flow lines along each branch thereof.

When using aluminum alloy, such as JIS 2014 alloy or JIS 6061 alloy, the larger the plastic flow amount, the larger the mechanical strength. However, when the plastic flow amount is excessive, there give rise to enlarged crystal grains in part of a forged particle. The enlarged crystal grains lower the mechanical strength to a great extent. In the conventional forging methods accompanied with flashes, the plastic flow amount is large in the vicinity of the parting line and this makes the crystal grains large in the vicinity of the parting line, resulting in reduction in the mechanical strength.

According to the present invention, however, no parting line exists because of the absence of any flash. Therefore, the present forging method can suppress enlargement of crystal grains, as compared with the conventional forging methods. Thus, the present forging method is superior to the conventional forging methods because no local reduction in mechanical strength arises in the present forging method.

Since the forging preform of an upper arm or a lower arm, which is a suspension part for a vehicle, produced by means of the forging method has no flashes, no flash removal mark is formed on the preform, and the yield of the preform on the basis of the forging material is high.

According to the method of the present invention, a yoke, which is a joint part employed in a suspension part for a vehicle, can be produced by applying pressure onto the side surface of a cylindrical forging material. In addition, load to be applied during forging can be reduced, and the yield of a final product on the basis of the forging material is high. The yoke, which is a suspension part for a vehicle, is produced by means of the forging method such that plastic flow of the forging material occurs along a plurality of branches. That is, stratiform metal flow occurs along the contours of the branches. As a result, the mechanical strength of the branches is enhanced.

Since the yoke, which is a suspension part for a vehicle, produced by means of the forging method has no flash, no flash removal mark is formed on the yoke, and the yield of the yoke on the basis of the forging material is high.

The closed forging production system using the closed forging method of the present invention will next be described.

An example of the closed forging production system will be roughly described with reference to FIG. 10.

Figure 10:
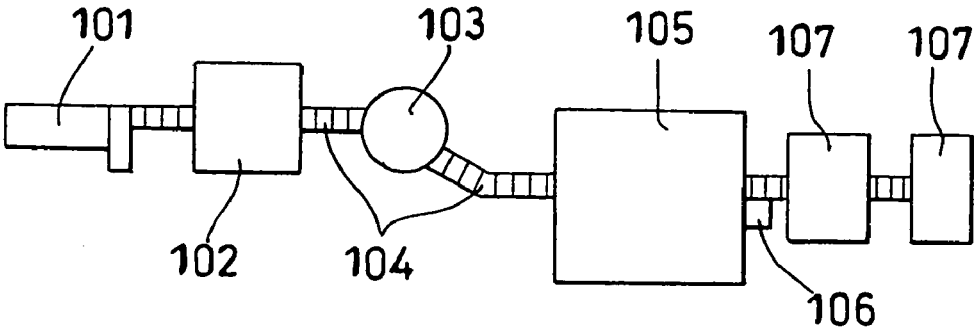
FIG. 10 is a schematic representation showing a closed forging production system of yet another embodiment of the present invention.

In FIG. 10, the closed forging production system comprises a material cutting apparatus 101 and a forging machine 105. In the case of hot forging requiring heating of a forging material before forging, the production system preferably includes a material-heating apparatus 103. More preferably, the production system includes a material feeding apparatus 102, a material conveying apparatus 104 and a forged product conveying apparatus 106 so as to realize a completely automatic production system. When a forged product assumes the shape of a final product, a forged product heat treatment furnace 107 is preferably provided.

The material cutting apparatus 101 is provided for cutting a continuously cast round bar into pieces each having the same volume as a forged product. The material feeding apparatus 102 is provided for storing a predetermined amount of a forging material in a hopper, and then feeding the material to the subsequent apparatus. The material conveying apparatus 104 is provided for conveying the forging material to a die. The forging machine 105 is provided for subjecting the forging material to forging. The forged product conveying apparatus 106 is provided for discharging a forged product from the forging die by means of a knock-out mechanism or discharging from the forging die a forged product in separate-type dice and then conveying the forged product to the downstream apparatus. The material heating apparatus 103 is provided for heating the material to enhance forgeability thereof. The forged product heat treatment furnace 107 is provided for subjecting the forged product to heat treatment that includes continuous solid solution treatment and continuous aging treatment.

The structure of the forging die of the present invention employed in the forging machine will be roughly described with reference to FIG. 11.

The forging die of the present invention includes a punch 111, dice 112, a bush 113 and a knock-out 114. In the case of hot forging requiring heating of a forging material before forging, for example, a lubricant spraying apparatus 115 for spraying a lubricant to the die is preferably provided, when necessary, on the forging die or in the forging machine. The lubricant spraying apparatus 115 may be provided separately from the forging machine, and operation of the apparatus may be linked with that of the forging machine.

The die of the present invention is designed such that a cylindrical cast ingot (forging material) can be placed in a space defined by the dice, knock-out and/or bush and that pressure is applied onto the side surface of the cylindrical cast ingot. The cylindrical cast ingot has the same volume as a forged product and assumes a shape having an upper surface, a lower surface and a side surface, containing no angular portion and having a ratio of the lateral length of a projection profile of the ingot in the direction perpendicular to the direction of pressure application to the length of the ingot as measured in the direction of pressure application, which ratio is 1 or less.

Preferably, the die of the present invention is designed such that a member having a plurality of branches is produced through closed forging of a cylindrical piece (forging material). The cylindrical piece can be placed in a space defined by the dice, punch, knock-out and/or bush, and pressure is applied onto the side surface of the cylindrical piece. The cylindrical piece is obtained by cutting a round bar so that the ratio T/R of the piece thickness (T mm) to the piece diameter (R mm) is 1 or less and that the piece has a volume the same as the volume (V $mm^3$) of a forged product.

From the viewpoint of metal flow, in particular, the die is preferably designed such that the cylindrical piece can be placed in the aforementioned space so as to be in contact with the vicinity of the confluence of extending branches.

Preferably, the die of the present invention has a space defined by the dice, punch, knock-out and/or bush so that the relation $(1/3)\times L \leqq R = 2\times\sqrt{(V/T\pi)} \leqq L$ is satisfied among the volume (V $mm^3$) of a forged product, the thickness (T mm) of a round bar material, the longitudinal length (L mm) of a projection profile of the forged product as viewed in the direction perpendicular to the direction of pressure application, and the diameter (R mm) of the round bar material.

Preferably, the die of the present invention has a space defined by the dice, punch, the knock-out, and/or the bush so that the thickness (T mm) of a round bar material is 0.8 to 1.0×(the lateral length (t mm) of a projection profile of a forged product as viewed in the direction perpendicular to the direction of pressure application).

The closed forging production system of the present invention includes a die which is designed such that a cylindrical cast ingot (forging material) can be placed in a space defined by the dice, punch, knock-out and/or bush and that pressure is applied onto the side surface of the cylindrical cast ingot. The cylindrical cast ingot has the same volume as a forged product and assumes a shape having an upper surface, a lower surface and a side surface, containing no angular portion and having a ratio of the lateral length of a projection profile of the ingot in a direction perpendicular to the direction of pressure application to the length of the ingot as measured in the direction of pressure application, which ratio is 1 or less.

Preferably, the closed forging production system of the present invention includes a die that is designed such that a member having a plurality of branches is produced through closed-forging of a cylindrical piece (forging material) The cylindrical piece can be placed in a space defined by the dice, punch, knock-out and/or bush so that pressure can be applied onto the side surface of the cylindrical piece. The cylindrical piece is obtained by cutting a round bar material so that the ratio T/R of the piece thickness (T mm) to the piece diameter (R mm) is 1 or less and that the piece has a volume same as the volume (V $mm^3$) of a forged product.

The forging die employed in the closed forging production system of the present invention may be formed of only one type of member selected from a combination of dice, a bush and a knock-out that is a unit-type die formed of die blocks only and a combination of dice and a plurality of bushes incorporated therein that is a separate-type die. From the viewpoint of improvement of the service life of the forging die, a separate-type die is more preferable.

The die of the present invention is designed such that a cylindrical cast ingot (forging material) can be placed in a space defined by the dice, punch, knock-out and/or bush and that pressure can be applied onto the side surface of the cylindrical cast ingot. The cylindrical cast ingot has the same volume as a forged product and assumes a shape having an upper surface, a lower surface, and a side surface, containing no angular portion and having a ratio of the lateral length of a projection profile of the ingot in the direction perpendicular to the direction of pressure application to the length of the ingot as measured in the direction of pressure application, which ratio is 1 or less. Therefore, load to be applied during forging can be reduced, the yield of the forged product on the basis of the forging material is high, and the mechanical strength of the forged product can be enhanced.

An embodiment of the forging method of the present invention employing the closed forging production system shown in FIG. 10 and the die shown in FIG. 11 will next be described.

The closed forging method of the present invention includes the steps of cutting a continuously cast round bar into pieces (forging materials) each having the same volume as a forged product, storing a predetermined amount of the forging materials in a hopper, feeding each forging material to the subsequent step of conveying the forging material to a die, subjecting the conveyed forging material to forging, discharging a forged product from the die by means of a knock-out mechanism and subjecting the resultant forged product to heat treatment including continuous solid solution treatment and continuous aging treatment.

In the case of cold forging in which a forging material is forged at ambient temperature to thereby produce a forged product having a simple shape, from the viewpoints of reduction of forging load and prevention of sticking between a forged product and a die, if desired, a bonde treatment step for subjecting the forging material to chemical coating treatment is preferably carried out prior to the forging step.

In the case of hot forging in which a forging material is heated and then forged to produce a forged product having a complicated shape, from the viewpoints of reduction of forging load and prevention of sticking between a forged product and a die, if desired, any one of steps is preferably carried out, which are steps of pre-heating a forging material, subjecting the forging material to water-soluble graphite lubrication treatment prior to forging, pre-heating a closed forging die to a predetermined temperature spraying a water-soluble graphite lubricant onto a portion of the closed forging die where the forging material is forged.

An example of the configuration of the separate-type die equipped having the drive mechanism, used as the closed forging die, will be described with reference to FIG. 12.

In FIG. 12, paired separate dice 121 are disposed at a predetermined interval, with their front surfaces having molding portions facing each other. Each of the back surfaces of the paired separate dice 121 is provided with an arm 122 to which a drive mechanism (not shown), such as a hydraulic cylinder, electric motor, etc., is connected via a power transmission mechanism. During forging, the paired separate dice 121 move toward each other for coming into pressure contact to form a closed forging die.

After completion of forging, the drive mechanism is driven in the reverse direction to open the separate dice for removal of a forged product.

The position of the arm 122 provided on the back surface of each of the separate dice 121 is preferably at the rear surface of the confluence of the branches because no unbalanced load is exerted onto the rear surface. In the case where a product requiring precise dimensions is to be forged, plural arms may be provided at required places of each of the separate dice to form a forging die.

In the example shown in FIG. 12, a drive mechanism is connected to each of the separate dice. However, a drive mechanism may be connected to one of the separate dice, with the other thereof fixed, and driven to perform forging.

Use of the separate dice can attain the same effects as use of the closed forging die and enables a forged product to be discharged not only in the upper direction of the dice, but also in the direction opening the dice. This enables the forged product to be extracted from the dice, irrespective of, the amount of the stroke of the knock-out. In particular, a forged product having an undercut shape that cannot be obtained by use of the closed forging die can be produced when using the separate dice. The "undercut shape" refers to a shape that cannot be extracted even when using a knock-out mechanism.

Furthermore, since the separate-type die is separated into two dice, a lubricant can be sprayed onto the entire die with ease, enhanced maintenance of the dice can be attained.

The closed forging production system of the present invention employs a forging die which is designed such that a cylindrical cast ingot (forging material) can be placed in a space defined by the punch, dice, knock-out and/or the bush and that pressure is applied onto the side surface of the cylindrical cast ingot. The cylindrical cast ingot has the same volume as a forged product and assumes a shape having an upper surface, a lower surface and a side surface, containing no angular portion and having a ratio of the lateral length of a projection profile of the ingot as viewed in the direction perpendicular to the direction of pressure application to the length of the ingot as measured in the direction of pressure application, which ratio is 1 or less. Therefore, load to be applied during forging can be reduced, the yield of the forged product on the basis of the forging material is high, and the mechanical strength of the forged product can be enhanced.

The present invention will next be described in detail with reference to Examples, which should not be construed as limiting the invention thereto.

EXAMPLE 1

In order to produce through forging a yoke 43 shown in FIG. 2, which is a joint part employed in a vehicle suspension, a cut piece of JIS 6061 aluminum alloy having the same volume as the yoke 43 was designed as the forging material in the following manner.

The volume of the yoke 43 was calculated by means of a CAD system programmed in a computer. On the basis of the results of the calculation, the volume of a cut piece was designed to be 38.8 $cm^3$. The volume tolerance of the cut piece was determined to be +1% on the basis of the calculated volume of the yoke.

Subsequently, the thickness (T) of the cut piece was designed to be 34 mm, which is 0.95 times the lateral length (t) represented by reference letter B (shown in FIG. 14) of a projection profile of a forged product in a direction perpendicular to the pressure application direction represented by reference letter A shown in FIG. 13. On the basis of the volume and thickness of the cut piece, the diameter (R) of the cut piece was determined by use of the following equation:

$$R=2\times\sqrt{(38{,}800/(34\pi))}.$$

Figure 14:
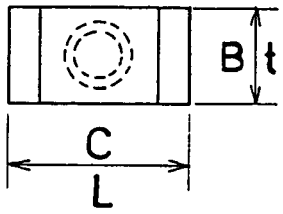
FIG. 14 is a projection profile perpendicular to the direction of pressure application shown in FIG. 13.

Here, R satisfies (⅓)×(longitudinal length L represented by reference letter C shown in FIG. 14)≦R≦(longitudinal length L represented by reference letter C shown in FIG. 14).

Figure 13:
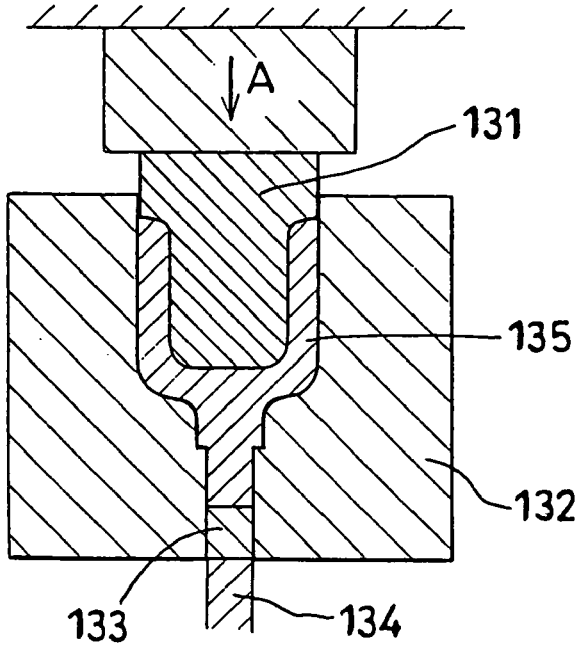
FIG. 13 is a cross-sectional view showing a state in which a yoke is produced through a closed forging method of yet another embodiment of the present invention.

Further, in FIG. 13, reference numeral 131 denotes a punch, numeral 133 a knock, numeral 134 a knock-out, and numeral 135 a yoke as a forged product.

On the basis of the aforementioned design, a continuously cast round bar of JIS 6061 aluminum alloy having a diameter of 38.1 mm was cut into 10 disk-shaped pieces, each having a diameter of 38.1 mm, a thickness of 34 mm and a volume of 38.8 $cm^3$. The 10 cut pieces had an average weight of 104.8 g.

Figure 15:
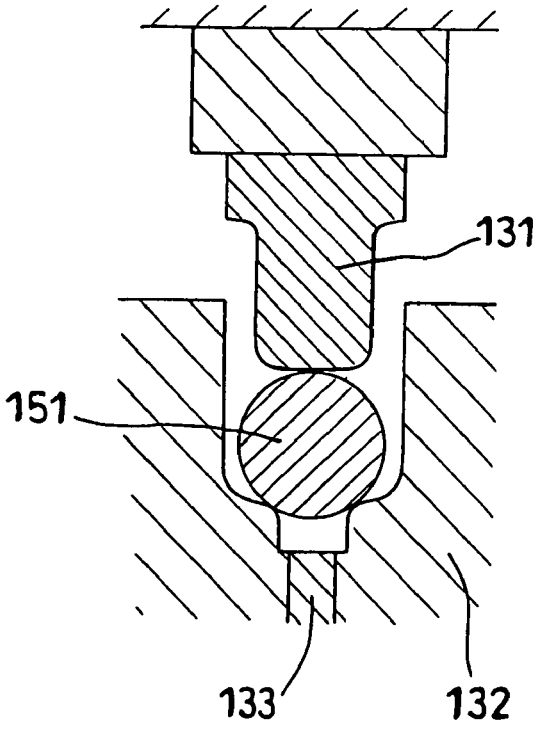
FIG. 15 shows a state in which a forging material is placed in the die shown in FIG. 13 before forging.

Each of the disk-shaped cut pieces 151 was subjected to conventionally known bonde treatment and then placed in a forging die as shown in FIG. 15. Subsequently, load was applied onto the outer peripheral surface of the cut piece by use of a punch at ambient temperature to thereby perform cold forging. A 400-t press apparatus (product of AIDA Inc.) was employed as a forging apparatus. The average forging load was 1,372 kN. The 10 forged products had an average weight of 104 g. The projection profiles of the forged products in the direction perpendicular to the direction of pressure application had an average longitudinal length L (represented by C in FIG. 14) of 51 mm.

During the course of forging under the aforementioned conditions, sticking, etc. were not observed in the forged product, and problems, such as a drastic increase in forging load, did not arise.

In order to check the quality of the forged products, appearance of the products was visually evaluated. As a result, percent occurrence of forging defects, such as sticking and overlap, was 0%. That is to say, (the number of samples having forging defects/the total number of samples)=(0/10). Since sticking did not occur, the plastic flow resistance of the forging material did not increase, and forging load did not increase drastically. It is expected that the service life of the forging die can be extended, since forging load does not increase drastically.

The yield by weight of the forged product on the basis of the forging material was about 99%.

COMPARATIVE EXAMPLE 1

Figure 2:
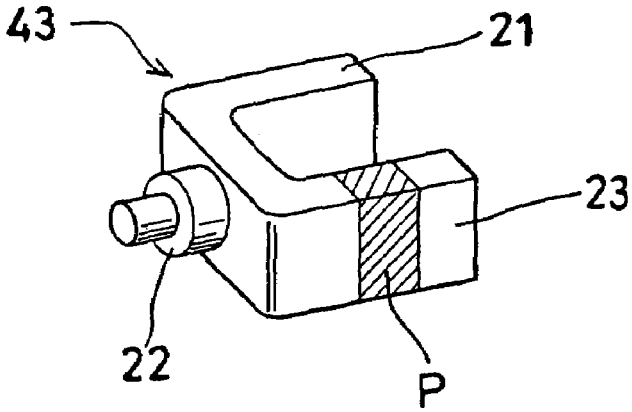
FIG. 2 shows a yoke of another embodiment of the present invention.
Figure 3:
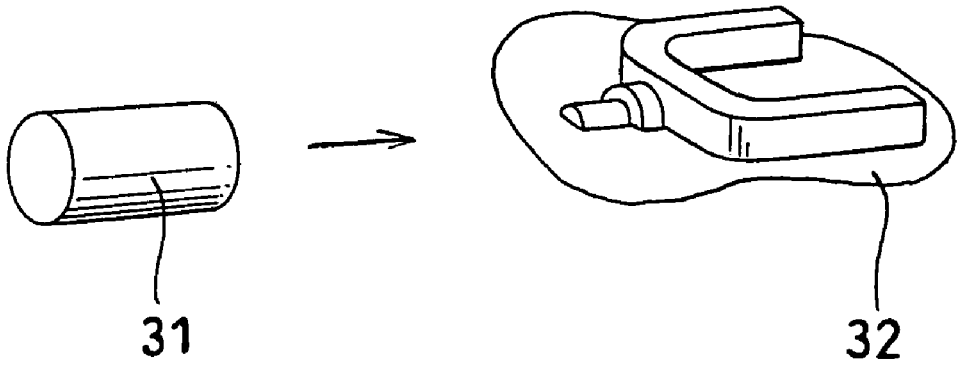
FIG. 3 is schematic representation showing a hot forging method for producing a yoke, with flashes formed around it.
Figure 4:
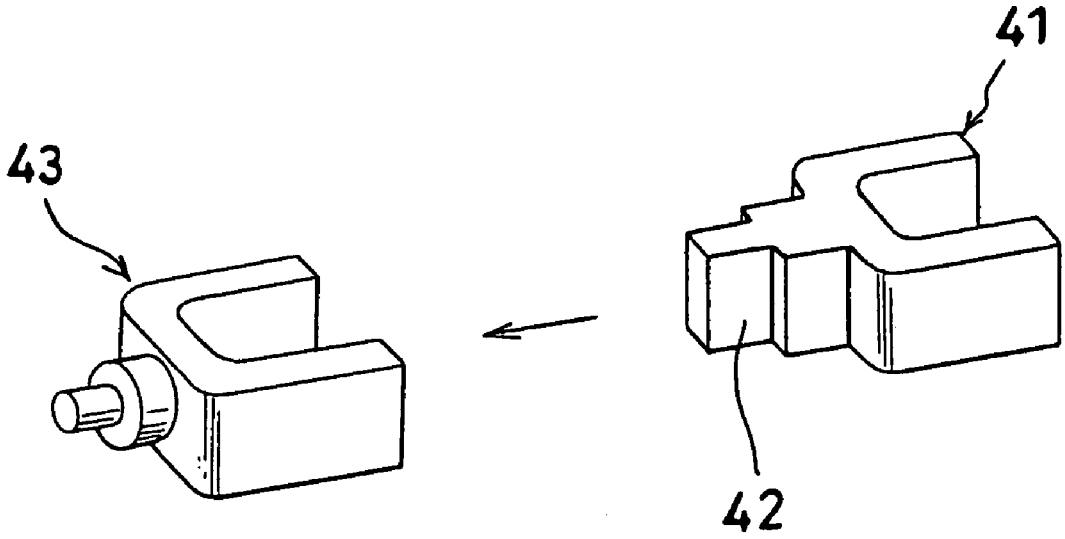
FIG. 4 is a schematic representation showing a method for producing a yoke through extrusion, cutting and machining.

A yoke 43 shown in FIG. 2, which is a joint part employed in a suspension for vehicles, was produced through conventional hot forging accompanied with flashes.

In order to prepare a forging material, a JIS 6061 continuously cast round bar having a diameter of 40.6 mm was cut into 10 disk-shaped pieces 161, each having a diameter of 40.6 mm, a thickness of 50 mm and a volume of 65 $cm^3$. The 10 cut pieces had an average weight of 175 g.

Figure 16:
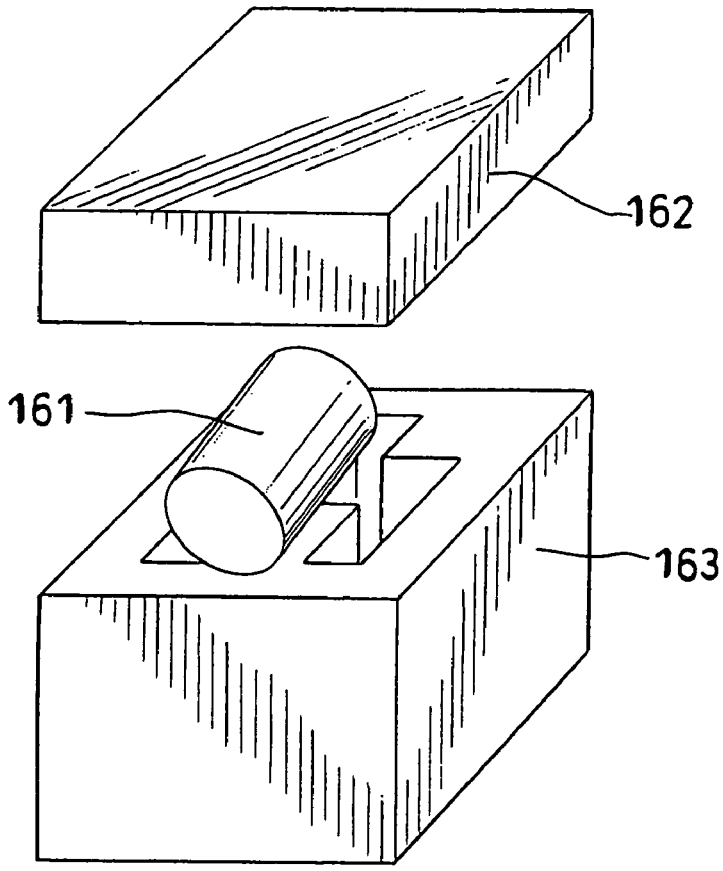
FIG. 16 shows the arrangement of a forging material and a die used in obtaining through hot forging a yoke, with flashes formed around it.

The surface of each of the disk-shaped cut pieces 161 was subjected to conventionally known coating treatment with a water-soluble graphite lubricant, and the piece was then placed in a forging die as shown in FIG. 16. Subsequently, in order to perform hot forging accompanied with flashes, the forging material was heated to 420° C., the die was pre-heated to 200° C., and a water-soluble graphite lubricant was sprayed onto the forging die. Thereafter, load was applied onto the outer peripheral surface of the cut piece by use of a punch to thereby perform hot forging. A 400-t press apparatus (product of AIDA Inc.) was employed as a forging apparatus. The average forging load was 2,940 kN. After completion of forging, the resultant flashes were removed by use of a trimming die to thereby obtain a forged product. The 10 forged products had an average weight of 104 g. The yield by weight of the forged product on the basis of the forging material was about 59%.

Figure 17:
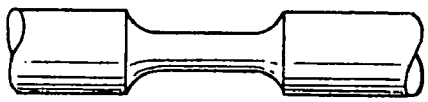
FIG. 17 shows a tensile test piece.

Strength Test and Metal Flow Observation:

The forged products produced in Example 1 and Comparative Example 1 were subjected to heat treatment including solid solution treatment at 510° C. for six hours and aging treatment at 170° C. for six hours. Thereafter, a tensile test piece ASTM-R5 shown in FIG. 17 having a width of 2.87 mm and a gauge length of 11.5 mm was obtained through cutting from each of the forged products at a position corresponding to position P shown in FIG. 2, and mechanical properties of the test piece were evaluated. Tensile tests were performed by use of Autograph (product of Shimadzu Corporation) at a tensile load of 5 kN. Ten test pieces (for each of the forged products) were subjected to tensile tests. Data of mechanical properties obtained through the tensile tests are shown in Table 1 below for the test pieces of Example 1 and Table 2 below for the test pieces of Comparative Example 1

TABLE 1

| Test piece | Tensile strength ($N/mm^2$) | 0.2% Proof stress ($N/mm^2$) | Elongation (%) |
|---|---|---|---|
| 1 | 328.33 | 307.01 | 16.5 |
| 2 | 330.43 | 304.32 | 18.9 |
| 3 | 332.91 | 302.95 | 17.6 |
| 4 | 332.91 | 304.55 | 18.7 |
| 5 | 329.67 | 299.93 | 17.5 |
| 6 | 332.91 | 304.55 | 18.3 |
| 7 | 330.62 | 299.41 | 18.0 |
| 8 | 331.19 | 300.00 | 17.4 |
| 9 | 330.22 | 317.11 | 19.2 |
| 10 | 329.08 | 297.65 | 19.3 |
| Average | 330.83 | 303.75 | 18.1 |

TABLE 2

| Test piece | Tensile strength ($N/mm^2$) | 0.2% Proof stress ($N/mm^2$) | Elongation (%) |
|---|---|---|---|
| 1 | 305.10 | 277.60 | 16.8 |
| 2 | 305.29 | 275.09 | 17.7 |
| 3 | 300.68 | 273.92 | 18.5 |
| 4 | 301.23 | 273.60 | 17.6 |
| 5 | 310.12 | 283.01 | 19.5 |
| 6 | 309.55 | 280.18 | 19.5 |
| 7 | 301.09 | 271.31 | 18.6 |
| 8 | 304.91 | 276.30 | 7.5 |
| 9 | 306.82 | 279.16 | 20.3 |
| 10 | 306.05 | 278.39 | 19.2 |
| Average | 305.08 | 276.86 | 18.1 |

As is clear from Tables 1 and 2 above, the tensile strength and 0.2% proof stress of the forged product produced through the closed forging method of the present invention are about 10% higher than those of the forged product produced through conventional hot forging accompanied with flashes. Thus, the forged product of the present invention exhibits improved mechanical properties.

Subsequently, in order to observe metal flow in the branches of each of the forged products, a sample for observation of metal flow was obtained from the forged product through cutting. The surface of the sample at which metal flow was to be observed was polished by use of emery paper, and then the sample was subjected to etching treatment in which the sample was immersed in a 20% sodium hydroxide solution for 30 seconds. For evaluation of metal flow, the macrostructure of the resultant sample was visually observed. As a result, in the forged product produced through the method of the present invention, forging defects, such as overlap, were not observed, since a corner edge at which the cut surface of the forging material meets the outer peripheral surface thereof fell on the peripheral outline of the forged product. Furthermore, uniform metal flow along a plurality of branches of the forged product was observed, layers of metal flow did not end at the surface of the product, and disturbance of the layers was not observed. The results show that stratiform plastic flow of the forging material occurs along the branches of the forged product. In contrast, observation, under the aforementioned conditions, of the macrostructure of the forged product produced through the conventional hot forging accompanied with flashes revealed that metal flow occurred other than along a plurality of branches of the forged product.

Since a trimming step that may be referred to as a "flash removing step" is not performed when a forged product is obtained through the closed forging method of the present invention, the resultant forged product has no flash removal mark, meaning that the yield of the product on the basis of the forging material is high. In contrast, when a forged product is produced through the conventional hot forging accompanied with flashes, since a trimming step must be performed for trimming the flashes from the resultant forged product, the product has flash removal marks.

EXAMPLE 2

Figure 18:
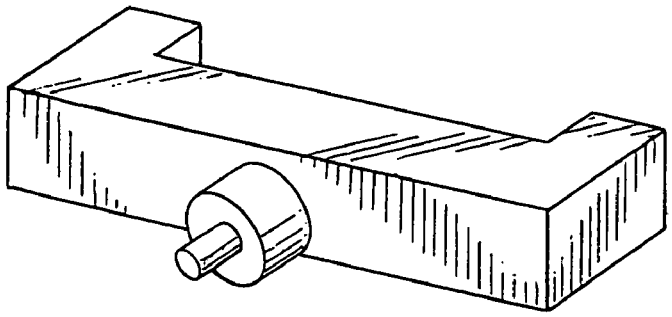
FIG. 18 shows a yoke produced in Example 2.

In order to produce a yoke shown in FIG. 18, which is a joint part employed in a suspension for vehicles, a cut piece of JIS 6061 aluminum alloy having the same volume as the yoke was designed as the forging material in the following manner.

The volume of the yoke was calculated by means of a CAD system programmed in a computer. On the basis of the results of the calculation, the volume of a cut piece was designed to be 84.0 $cm^3$. The volume tolerance of the cut piece was determined to be ±1% on the basis of the calculated volume of the yoke.

Subsequently, the thickness of the cut piece was designed to be 30 mm, which is 0.95 times the lateral length (t) represented by reference letter E shown in FIG. 20 of a projection profile of a forged product in the direction perpendicular to the pressure application direction D shown in FIG. 19. On the basis of the volume and thickness of the cut piece, the diameter (R) of the cut piece was determined by use of the equation:

$$R=2\times\sqrt{(84{,}000/(30\pi))}.$$

Here, R does not satisfy the condition: (⅓)×(longitudinal length (L) represented by reference letter F in FIG. 20)≦R≦(longitudinal length (L) represented by reference letter F in FIG. 20), but satisfies the condition: R≦(⅓)×(longitudinal length (L) represented by reference letter F in FIG. 20).

Figure 19:
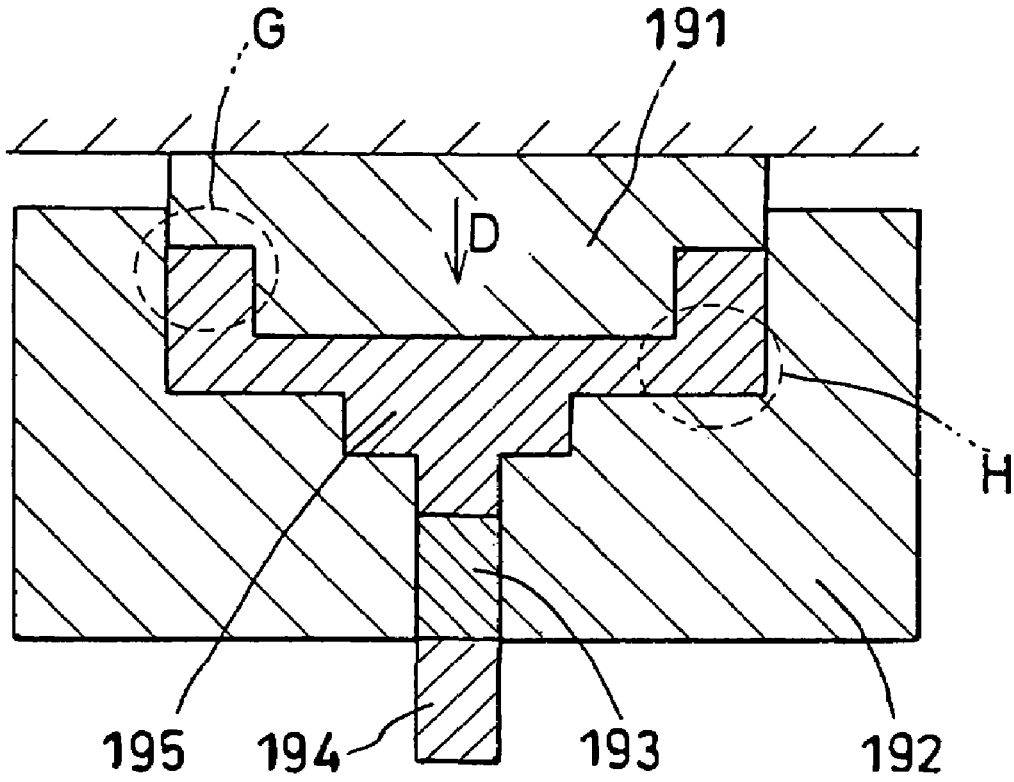
FIG. 19 is a cross-sectional view showing a state in which a yoke is produced through a closed forging method in Example 2.
Figure 20:
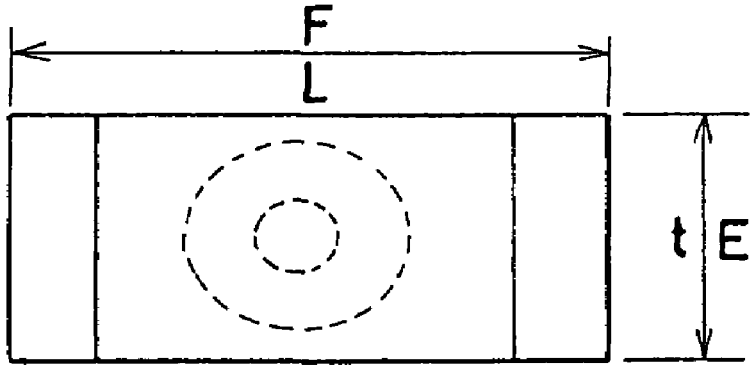
FIG. 20 is a projection profile perpendicular to the direction of pressure application shown in FIG. 19.

Further, in FIG. 19, reference numeral 191 denotes a punch, numeral 192 dice, numeral 193 a knock, numeral 194 a knock-out and numeral 195 a yoke as a forged product.

On the basis of the aforementioned design, a continuously cast round bar of JIS 6061 aluminum having a diameter of 59.7 mm was cut into 10 disk-shaped pieces, each having a diameter of 59.7 mm, a thickness of 30 mm and a volume of 84.0 $cm^3$. The 10 cut pieces had an average weight of 227 g.

Figure 21:
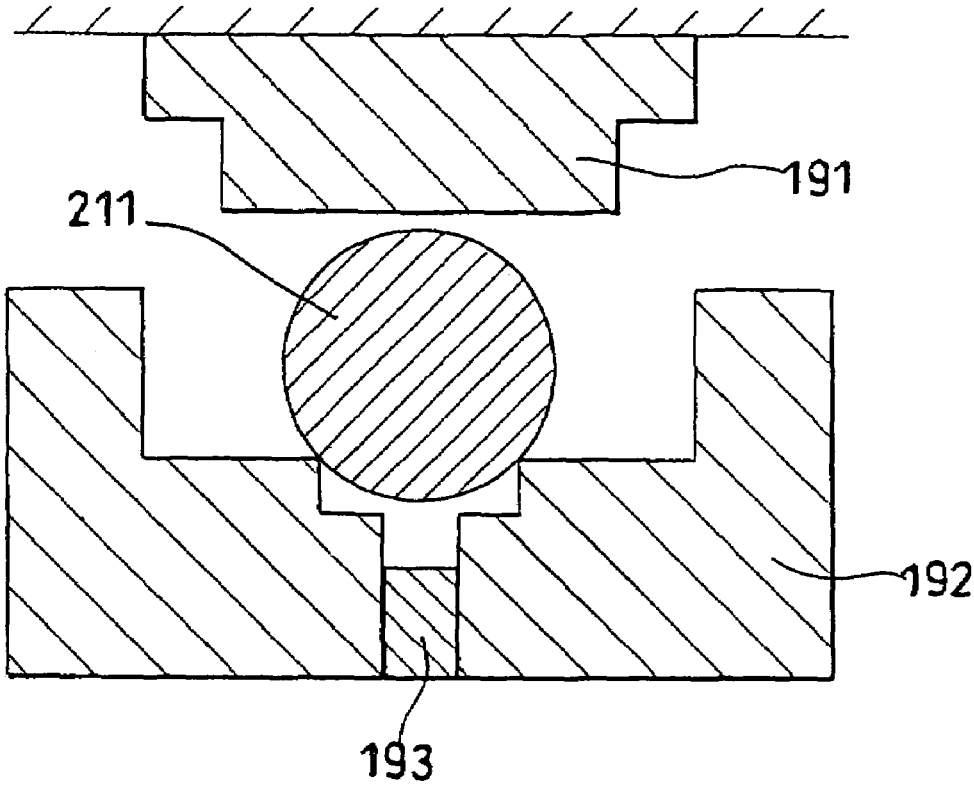
FIG. 21 shows a state in which a forging material is placed in the die shown in FIG. 19 before forging.

Each of the disk-shaped cut pieces 211 was subjected to conventionally known coating treatment with a bonde lubricant, and then placed in a forging die as shown in FIG. 21. Subsequently, load was applied onto the outer peripheral surface of the cut piece by use of a punch at ambient temperature to thereby perform cold forging. An 800-t press apparatus (product of Komatsu Seisakusho Co., Ltd.) was employed as a forging apparatus. The resultant forged products had an average weight of 226.5 g. The projection profiles of the forged products in the direction perpendicular to the direction of pressure application had an average longitudinal length (L) of 200 mm represented by reference letter F in FIG. 20.

Observation of the macrostructure of the forged product confirmed that a corner edge at which the cut surface of the forging material meets the outer peripheral surface thereof was along the peripheral outline of the forged product, that metal flow occurred along a plurality of branches of the forged product, and that stratiform plastic flow of the forging material occurred along the branches of the forged product.

When forging was performed under the aforementioned conditions, since plastic flow of the forging material occurred over a long distance until the material reached portion G shown in FIG. 19, sticking attributed to breakage of lubrication film between the forging material and the die was generated particularly in portion H of FIG. 19. Percent occurrence of sticking was 80%. That is to say, (the number of samples having sticking/the total number of samples)=(8/10). The sticking attributed to breakage of lubrication film between the forging material and the die was removed from the surface of the forged product.

EXAMPLE 3

The thickness of disk-shaped cut pieces obtained from a round bar material was designed to be 25 mm, which is 0.7 times the lateral length represented by reference letter B shown in FIG. 14. The diameter (R) of the cut pieces was determined to be 44 mm by use of the equation:

$$R=2\times\sqrt{(38{,}800/(25\pi))}.$$

Here, R satisfies the condition: R≦(longitudinal length (L) represented by reference letter C in FIG. 14).

By use of the cut pieces, forging was performed in a manner similar to that of Example 1. As a result, since the cut pieces (forging material) were not stabilized in a forging die and were inclined in the die during forging, percent occurrence of forging defects, such as underfill and overlap, in the resultant forged products was 50%.

EXAMPLE 4

In order to produce a preform of an upper arm shown in FIG. 6, which is a suspension part for a vehicle, a cut piece of JIS 6061 aluminum alloy (forging material) having the same volume as the preform was designed as follows.

The volume of the upper arm preform was calculated by means of a CAD system programmed in a computer. On the basis of the results of the calculation, the volume of a cut piece was designed to be 862 $cm^3$. The volume tolerance of the cut piece was determined to be ±1% on the basis of the calculated volume of the preform.

Figure 22:
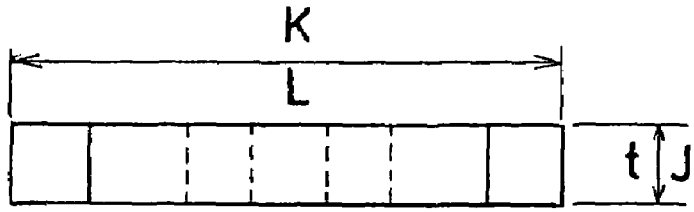
FIG. 22 is a projection profile perpendicular to the direction of pressure application shown in FIG. 1.

Subsequently, the thickness of the cut piece was designed to be 28 mm, which is 0.95 times the lateral length (t) represented by reference letter J shown in FIG. 22 of a projection profile of a forged product in the direction perpendicular to the pressure application direction I shown in FIG. 1. On the basis of the volume and thickness of the cut piece, the diameter (R) of the cut piece was determined by use of the equation:

$$R=2\times\sqrt{(862{,}000/(28\pi))}.$$

Here, R satisfies the condition: (⅓)×(longitudinal length (L) represented by reference letter K in FIG. 22)≦R≦(longitudinal length (L) represented by reference letter K in FIG. 22).

On the basis of the aforementioned design, a continuously cast billet material of JIS 6061 aluminum alloy having a diameter of 198 mm was cut into 10 disk-shaped pieces, each having a diameter of 198 mm, a thickness of 28 mm and a volume of 862 $cm^3$. The 10 cut pieces had an average weight of 2,330 g.

Further, in FIG. 1, reference numeral 11 denotes a punch, numeral 12 dice, numeral 13 a knock, numeral 14 a knock-out and numeral 15 a forging perform of an upper arm.

Figure 23:
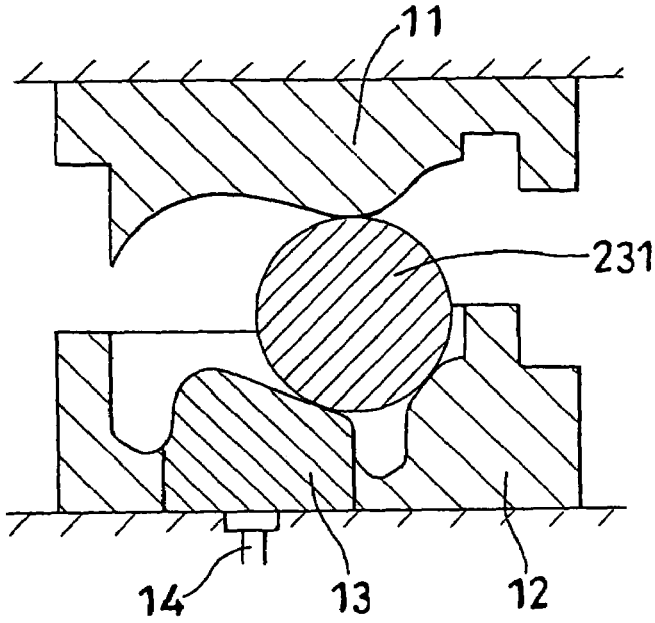
FIG. 23 shows a state in which a forging material is placed in the die shown in FIG. 1 before forging.

The surface of each of the disk-shaped cut pieces 231 was subjected to conventionally known coating treatment with a water-soluble graphite lubricant, and a conventionally known water-soluble graphite lubricant was sprayed onto a forging die. Subsequently, the cut piece was placed in the die as shown in FIG. 23, and load was applied onto the outer peripheral surface of the cut piece by use of a punch to thereby perform hot forging. A 3,000-t press (product of Sumitomo Heavy Industries, Ltd.) was employed as a forging apparatus. Hot forging was performed at a material heating temperature of 500° C. and a die temperature of 200° C. The average forging load was 6,370 kN. The average weight of the resultant forged products was 2,328 g. The projection profiles of the forged products in the direction perpendicular to the direction of pressure application had an average longitudinal length (L) of 392 mm represented by reference letter K in FIG. 22.

The yield by weight of the forged product on the basis of the forging material was about 99%.

Since stratiform plastic flow of the forging material occurred along a plurality of branches of the forged product, the mechanical strength of the product was improved. In addition, since the forged product was produced through the closed forging method of the present invention, the forged product had no trimming marks, and the yield of the product was high.

Figure 5:
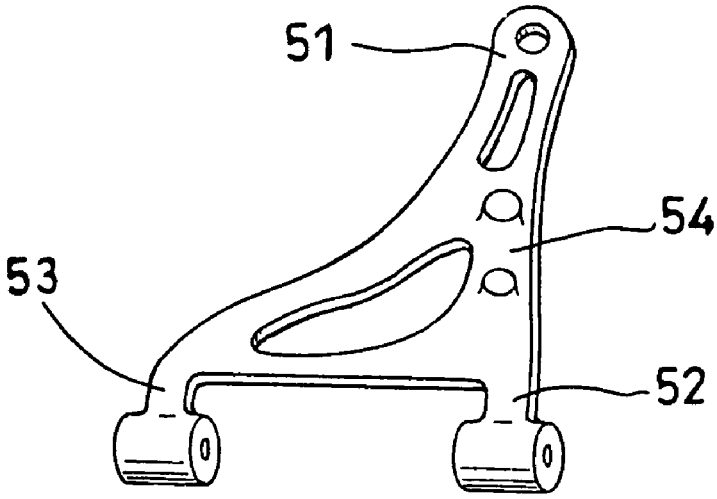
FIG. 5 shows an upper arm produced from a forging preform of yet another embodiment of the present invention.

A perform was subjected to the conventional hot forging method accompanied with flashes to produce an upper arm 54 shown in FIG. 5. Two forging steps were taken at a material heating temperature of 500° C. and a die temperature of 150° C. The forging load was 22,540 kN at the first forging step and 17,640 kN at the second forging step. A trimming die was used to remove the flashes from the forged body, and the shape of the resultant forged body was adjusted to obtain a forged product. In this case, the weight of the upper arm (forged product) shown in FIG. 5 was 1,650 g while the average weight of the cut disks was 2,330 g. Therefore, the yield by weight of the product on the basis of the material was 71%.

COMPARATIVE EXAMPLE 2

Figure 7:
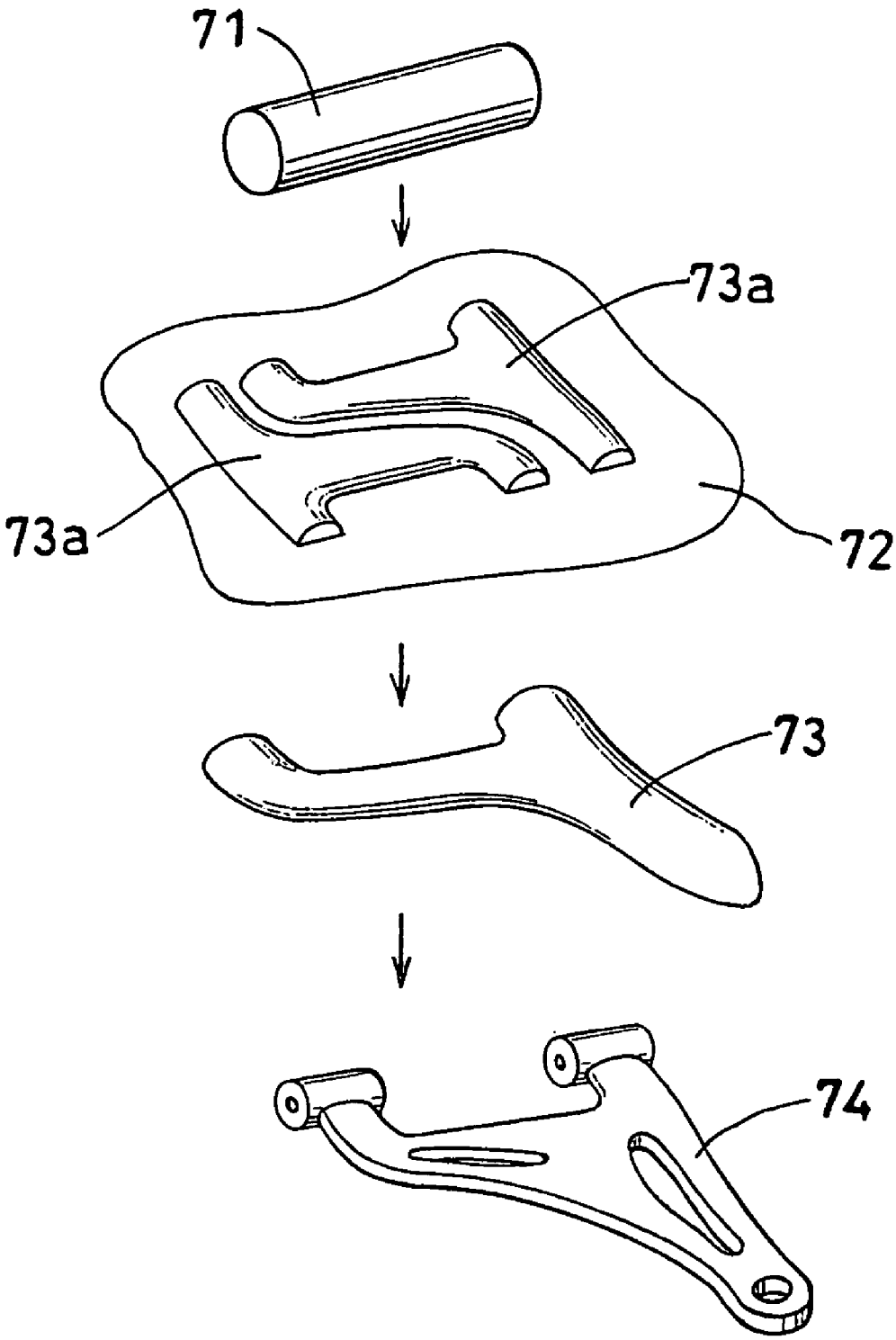
FIG. 7 is a schematic representation showing a hot forging method for producing an upper arm, with flashes formed around upper arm performs.
Figure 8:
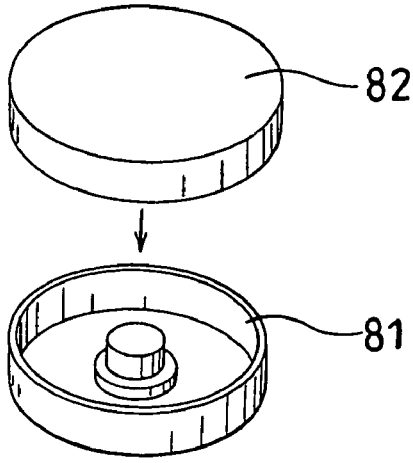
FIG. 8 is a schematic representation showing a closed forging method for producing a VTR cylinder.
Figure 9:
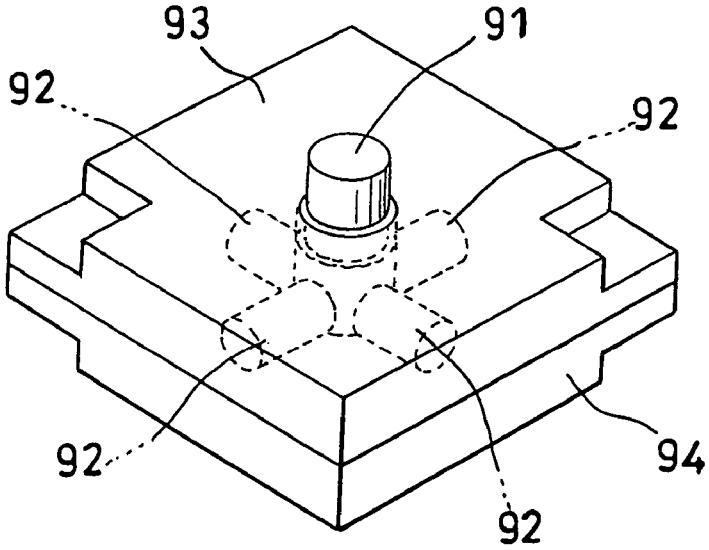
FIG. 9 is a schematic representation showing a closed forging method disclosed in JP-A HEI 1-166842.

A preform of the upper arm in Example 4 was produced through conventional hot forging accompanied with flashes shown in FIG. 7. Hot forging was performed at a material heating temperature of 500° C. and a die temperature of 180° C. A cut piece (forging material) having a diameter of 80 mm, a length of 360 mm, a volume of 1,810 $cm^3$ and a weight of 4,900 g, was obtained from a continuously cast round bar of JIS 6061 aluminum alloy having a diameter of 80 mm. In this hot forging, forging load was 49,000 kN. After completion of the forging, a trimming die was used to remove the flashes to obtain a forged body, the shape of which was then adjusted to obtain a forged product. In this forging process, two upper arm preforms were produced from one piece of forging material. The two forged products had an average weight of 1,960 g. Forging load required for producing one preform was calculated by halving the aforementioned forging load, and was determined to be about 24,500 kN. The yield by weight of the forged product on the basis of the forging material was 80%.

A perform was subjected to the conventional hot forging method accompanied with flashes to produce an upper arm 74 shown in FIG. 7. Two forging steps were taken at a material heating temperature of 500° C. and a die temperature of 180° C. The forging load was 14,700 kN at the first forging step and 14,700 kN at the second forging step. A trimming die was used to remove the flashes from the forged body, the shape of which was adjusted to obtain a forged product. In this case, the weight of each of the two upper arms 74 (forged products) shown in FIG. 7 was 1,650 g while the weight of the cut piece 71 was 4,900 g. Therefore, the yield by weight of the product on the basis of the material was 67%.

EXAMPLE 5

Figure 24:
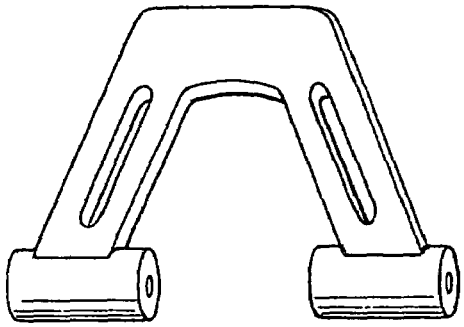
FIG. 24 shows an upper arm, which is a suspension part for vehicles, produced from a forging preform of yet another embodiment of the present invention.
Figure 25:
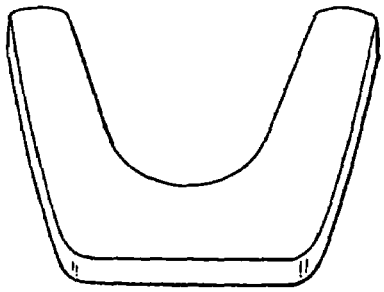
FIG. 25 shows a forging preform of yet another embodiment of the present invention, which is used for producing the upper arm shown in FIG. 24.

In order to produce an upper arm shown in FIG. 24, which is a suspension part for a vehicle, a forging preform shown in FIG. 25 of the upper arm was produced. A cut piece of JIS 6061 aluminum alloy (forging material) having the same volume as the forging preform was designed as follows.

The volume of the upper arm preform was calculated by means of a CAD system programmed in a computer. On the basis of the results of the calculation, the volume of a cut piece was designed to be 595 $cm^3$. The volume tolerance of the cut piece was determined to be ±1% on the basis of the calculated volume of the preform.

Subsequently, the thickness of the cut piece was designed to be 30 mm, which is 0.95 times the lateral length (t) represented by reference letter N shown in FIG. 27 of a projection profile of a forged product in the direction perpendicular to the pressure application direction M shown in FIG. 26. On the basis of the volume and thickness of the cut piece, the diameter (R) of the cut piece was determined by the equation:

$$R=2\times\sqrt{(595{,}000/(30\pi))}.$$

Here, R satisfies the condition: (⅓)×(longitudinal length (L) represented by reference letter O in FIG. 27)≦R≦(longitudinal length (L) represented by reference letter O in FIG. 27).

Figure 26:
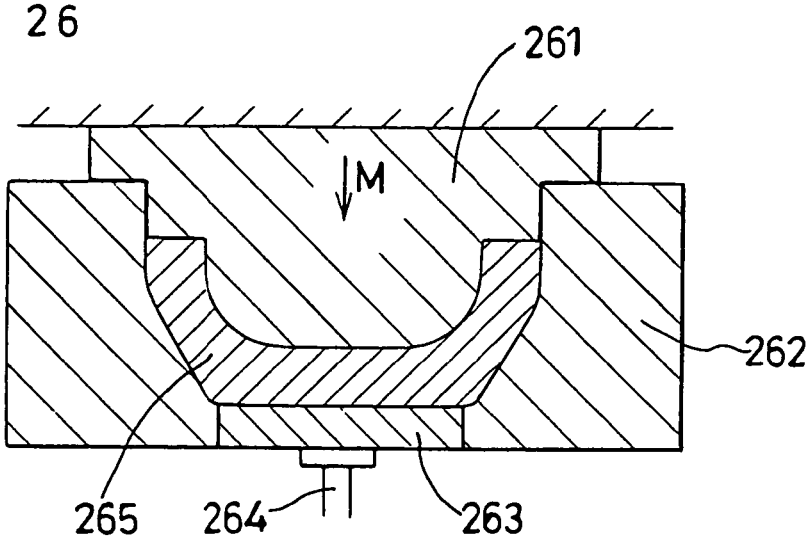
FIG. 26 is a cross-sectional view showing a state in which the preform shown in FIG. 25 is produced through a closed forging method.
Figure 27:
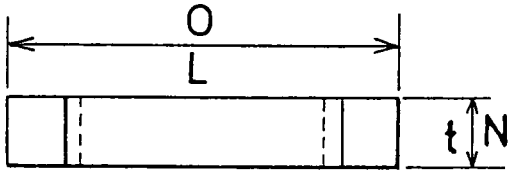
FIG. 27 is a projection profile perpendicular to the direction of pressure application shown in FIG. 26.

Further, in FIG. 26, reference numeral 261 denotes a punch, numeral 262 dice, numeral 263 a knock, numeral 264 a knock-out and numeral 265 a forging perform of an upper arm.

On the basis of the aforementioned design, a continuously cast billet material of JIS 6061 aluminum alloy having a diameter of 167 mm was cut into 10 disk-shaped pieces, each having a diameter of 167 mm, a thickness of 30 mm and a volume of 595 $cm^3$. The 10 cut pieces had an average weight of 1,607 g.

Figure 28:
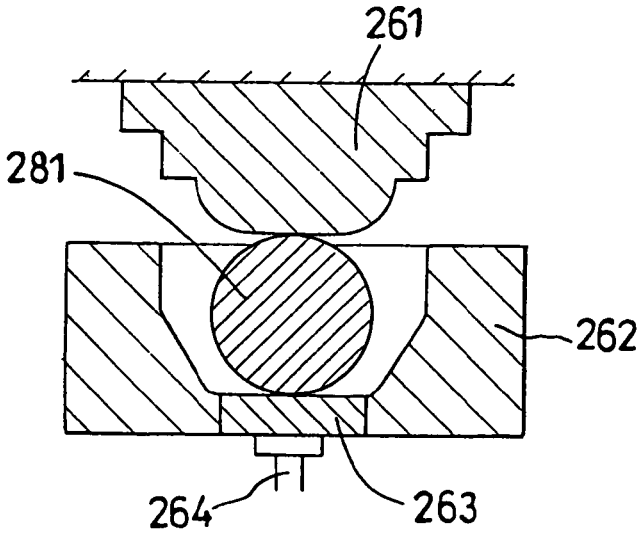
FIG. 28 shows a state in which a forging material is placed in the die shown in FIG. 26 before forging at which a tensile test piece is obtained

The surface of each of the disk-shaped cut pieces 281 was subjected to conventionally known coating treatment with a water-soluble graphite lubricant, and a conventionally known water-soluble graphite lubricant was sprayed onto a forging die. Subsequently, the cut piece was placed in the die as shown in FIG. 28, and load was applied onto the outer peripheral surface of the cut piece by use of a punch to thereby perform hot forging. A 3,000-t press (product of Sumitomo Heavy Industries, Ltd.) was employed as a forging apparatus. Hot forging was performed at a material heating temperature of 500° C. and a die temperature of 200° C. The average forging load was 4,900 kN.

The average weight of the resultant forged products was 1,800 g. The projection profiles of the forged products in the direction perpendicular to the direction of pressure application had an average longitudinal length (L) of 310 mm represented by O in FIG. 27.

The yield by weight of the forged product on the basis of the forging material was 99%.

Since stratiform plastic flow of the forging material occurred along a plurality of branches of the forged product, the mechanical strength of the product was improved. In addition, since the forged product was produced through the closed forging method of the present invention, the forged product had no trimming mark, and the yield of the product was high.

EXAMPLE 6

Forging was performed in the same manner and under the same conditions as in Example 4, except that the aluminum alloy species of the forging material was changed.

Figure 6:
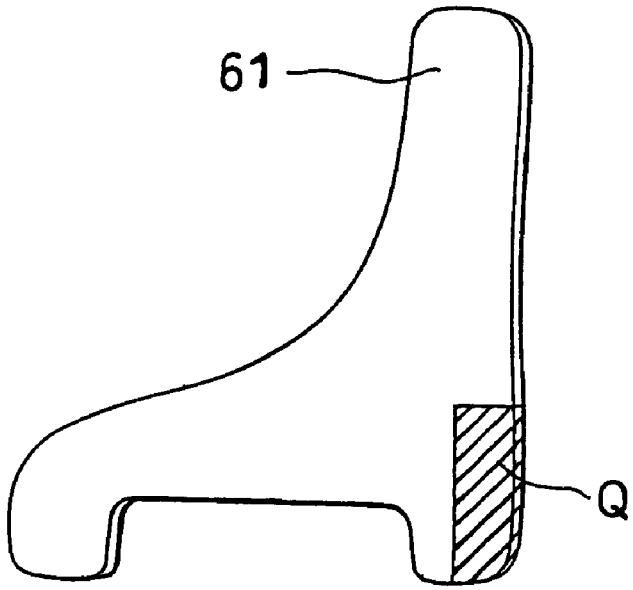
FIG. 6 shows an upper arm forging preform of yet another embodiment of the present invention.

In order to produce a preform of an upper arm shown in FIG. 6, which is a suspension part for a vehicle, a continuously cast bar of SU 610 aluminum alloy was cut into pieces (forging material) having the same volume as the preform. The aluminum alloy consists of 0.8 to 1.2 wt % of Mg, 0.7 to 1.0 wt % of Si, 0.3 to 0.6 wt % of Cu, 0.14 to 0.3 wt % of Cr, 0.14 to 0.3 wt % of Mn and the balance of Al and unavoidable impurities

COMPARATIVE EXAMPLE 3

Forging was performed using the same forging alloy species as in Example 6 under the same forging conditions as in Comparative Example 2.

Strength Test and Metal Flow Observation:

The forged products produced in Example 6 and Comparative Example 3 were subjected to heat treatment including solid solution treatment at 530° C. for six hours and aging treatment at 180° C. for six hours. Thereafter, a tensile test piece ASTM-R3 shown in FIG. 17 having a gauge diameter of 6.4 mm and a gauge length of 25.4 mm was obtained through cutting from each of the forged products at a position corresponding to position Q shown in FIG. 6, and mechanical properties of the test piece were evaluated. Tensile tests were performed by use of Autograph (product of Shimadzu Corporation) at a tensile load of 20 kN. Three test pieces (for each of the forged products) were subjected to tensile tests. Data of mechanical properties obtained through the tensile tests are shown in Table 3 below.

TABLE 3

| | Test piece | Tensile strength ($N/mm^2$) | 0.2% Proof stress ($N/mm^2$) | Elongation (%) |
|---|---|---|---|---|
| Ex. 6 | 1 | 385 | 333 | 15.7 |
| | 2 | 385 | 331 | 15.9 |
| | 3 | 387 | 333 | 16.6 |
| | Average | 386 | 332 | 16.1 |
| Com. | 1 | 358 | 325 | 8.4 |
| Ex. 3 | 2 | 356 | 323 | 12.2 |
| | 3 | 362 | 330 | 10.4 |
| | Average | 359 | 326 | 10.3 |

As is clear from Table 3 above, the tensile strength, 0.2% proof stress and elongation of the forged product produced through the closed forging method of the present invention are higher than those of the forged product produced through the conventional hot forging accompanied with flashes. Thus, the forged product of the present invention exhibits improved mechanical properties.

Subsequently, in order to observe metal flow in the branches of each of the forged products and crystal grains in the vicinity of the parting line, a sample for observation was obtained from the forged product through cutting. The surface of the sample to be observed was polished using emery paper, and then the sample was subjected to etching treatment in which the sample was immersed in a 20% sodium hydroxide solution for 30 seconds. For evaluation of metal flow and crystal grains in the vicinity of the parting line, the macrostructure of the resultant sample was visually observed. As a result, in the forged product produced through the method of the present invention, forging defects, such as overlap, were not observed, since a corner edge at which the cut surface of the forging material meets the outer peripheral surface thereof fell on the peripheral outline of the forged product. Furthermore, uniform metal flow along a plurality of branches of the forged product was observed, layers of metal flow did not end at the surface of the product, and disturbance of the layers was not observed. The results show that stratiform plastic flow of the forging material occurs along the branches of the forged product. Furthermore, no enlarged crystal grain was observed at the end of the forged product because the forged product has no parting line.

In contrast, observation, under the aforementioned conditions, of the macrostructure of the forged product produced through the conventional hot forging accompanied with flashes revealed that metal flow occurred other than along a plurality of branches of the forged product. In addition, enlarged crystal particles were observed in the vicinity of the parting lines at the end of the forged product.

EXAMPLE 7

Forging was performed under the same conditions as in Example 6, except that the separate-type dice 121 with a drive mechanism shown in FIG. 12 was used as the forging die.

One of the dice was mechanically driven, with the other thereof fixed. The dice were closed during the course of the punch being driven by the forging machine, and made open when the punch was stopped at an elevation end of the forging machine after completion of forging.

The forging conducted under these conditions resulted in no occurrence of inconvenience, such as an abrupt increase in forging load including sticking of the forged products.

INDUSTRIAL APPLICABILITY

According to the closed forging method of the present invention, there is employed, as a forging material, a cylindrical cast ingot which has the same volume as a forged product and assumes a shape having an upper surface, a lower surface and a side surface and containing no angular portion, wherein pressure is applied onto the side surface of the cylindrical forging material and the shape has a ratio of the lateral length of a projection profile of the ingot in the direction perpendicular to the direction of pressure application to the length of the ingot as measured in the direction of pressure application, which ratio is 1 or less. Therefore, since stratiform plastic flow of the forging material occurs along a plurality of branches of the forged product, mechanical properties of the forged product are improved. In addition, the forged product has no flash removal mark, and the yield of the product on the basis of the forging material is improved.

In the yoke of the present invention, which is a joint part employed in a vehicle suspension, stratiform plastic flow of a forging material occurs along a plurality of branches of the yoke. Therefore, the yoke exhibits improved mechanical properties. In addition, the yoke has no trimming mark, and the yield of the yoke on the basis of the forging material is high.

In the forging preform of an upper arm or lower arm of the present invention, which is a suspension part for a vehicle, stratiform plastic flow of a forging material occurs along a plurality of branches of the preform. Therefore, the preform exhibits improved mechanical properties. In addition, the preform has no trimming mark, and the yield of the preform on the basis of the forging material is high.

The die of the present invention is designed such that a cylindrical cast ingot (forging material) can be placed in a space defined by the punch, dice, knock-out and/or bush or a space defined by the punch and dice equipped with the drive mechanism and that pressure is applied onto the side surface of the cylindrical cast ingot. The cylindrical cast ingot has the same volume as a forged product and assumes a shape having an upper surface, a lower surface and a side surface, containing no angular portion and having a ratio of the lateral length of a projection profile of the ingot in the direction perpendicular to the direction of pressure application to the length of the ingot as measured in the direction of pressure application, which ratio is 1 or less. Therefore, load to be applied during forging can be reduced, the yield of the forged product on the basis of the forging material is high, and the mechanical strength of the forged product can be enhanced.

The closed forging production system of the present invention employs the forging die which is designed such that the cylindrical cast ingot (forging material) can be placed in a space defined by the punch, dice, knock-out and/or a bush or a space defined by the punch and dice equipped with the drive mechanism and that pressure is applied onto the side surface of the cylindrical cast ingot. The cylindrical cast ingot has the same volume as a forged product and assumes a shape having an upper surface, a lower surface and a side surface, containing no angular portion and having a ratio of the lateral length of a projection profile of the ingot in the direction perpendicular to the direction of pressure application to the length of the ingot as measured in the direction of pressure application, which ratio is 1 or les. Therefore, load to be applied during forging can be reduced, the yield of the forged product on the basis of the forging material is high, and the mechanical strength of the forged product can be enhanced.

The invention claimed is:

1. A closed forging method for producing a forged product, which comprises:

preparing a cylindrical cast ingot having a volume identical to a volume (V) of the forged product to be produced;

placing the cylindrical cast ingot in a forging die; and applying pressure to a side surface of the cylindrical cast ingot;

wherein a ratio of a thickness (T) of the cylindrical cast ingot to a diameter (R) of the cylindrical cast ingot is 1 or less, wherein the cylindrical cast ingot is placed in the forging die so that its thickness direction corresponds to a width direction of the forged product, and wherein the volume (V) of forged product, the thickness (T) of the cylindrical cast ingot, a longitudinal length (L) of the forged product and the diameter (R) of the cylindrical cast ingot satisfy the relation:

$$(1/3)\times L \leqq R = 2\times\sqrt{(V/T\pi)} \leqq L.$$

2. A closed forging method according to claim 1, wherein the cylindrical cast ingot is obtained by cutting a round bar material.

3. A closed forging method according to claim 1, wherein the thickness (T) of cylindrical cast ingot 0.8 to 1 times the width of the forged.

4. A closed forging method according to claim 1, wherein the cylindrical cast ingot is aluminum or an aluminum alloy.

5. A closed forging method according to claim 1, wherein the forged product is a member having a plurality of branches.

6. A closed forging method according to claim 5, wherein the member is a preform of an upper arm or a lower arm that is a suspension part for a vehicle.

7. A closed forging method according to claim 5, wherein the member is a yoke that is a joint part employed in a vehicle suspension.

* * * * *